US005895167A

United States Patent [19]

Chang

[11] Patent Number: 5,895,167

[45] Date of Patent: Apr. 20, 1999

[54] FOLDABLE ROD ASSEMBLY

[76] Inventor: Yin-Tang Chang, 1F, No. 12, Lane 106, Sec. 3, Min-Chuan E. Road, Taipei City, Taiwan

[21] Appl. No.: 08/965,954

[22] Filed: Nov. 7, 1997

[30] Foreign Application Priority Data

Jan. 10, 1997 [TW] Taiwan ..... 86200384

[51] Int. Cl.[6] ..... F16B 2/02

[52] U.S. Cl. ..... 403/310; 403/79; 403/306; 403/161; 135/150; 135/151; 312/6

[58] Field of Search ..... 403/310, 79, 306, 403/287, 119, 164, 161; 135/150, 151, 900, 901, 902, 149, 152; 312/3, 4, 5, 6, 258

[56] References Cited

U.S. PATENT DOCUMENTS

| | | | |
|---|---|---|---|
| 1,815,142 | 7/1931 | Douglas et al. | 312/6 |
| 1,966,561 | 7/1934 | Ratta, Jr. | 135/900 X |
| 4,836,485 | 6/1989 | Cooper | 403/79 X |
| 5,638,853 | 6/1997 | Tsai | 135/151 X |

*Primary Examiner*—Brian K. Green
*Assistant Examiner*—William L. Miller
*Attorney, Agent, or Firm*—Fish & Richardson P.C.

[57] ABSTRACT

A foldable rod assembly includes first and second rods of predetermined dimensions and having connecting ends with pivot holes, and a coupler unit for coupling pivotally the connecting ends. The coupler unit includes two elongate plates respectively having right and left longitudinal sides, upper and lower transverse sides, and upper and lower pivot holes disposed in symmetry to a middle line between the transverse sides. A blocking member extends transversely from the right longitudinal side proximate to the upper transverse side. Two protrusions extend from the left longitudinal side parallel to the blocking members respectively and proximate to the transverse sides. Two pins are inserted into the pivot holes of the elongate plates and the connecting ends of the first and second rods when the elongate plates are opposed to each other with a first transverse distance defined therebetween which is slightly larger than the predetermined dimension of the rods while one of the elongate plates is turned 180 degrees relative to the middle line so that the blocking members are located in a plane defined by the right longitudinal sides of the elongate plates at a diagonal position. The protrusions of the elongate plates define a second transverse distance which is smaller than the predetermined dimensions for sliding retention by the connecting ends when the latter are folded about the pin members.

4 Claims, 6 Drawing Sheets

FOLDABLE ROD ASSEMBLY

BACKGROUND OF THE INVENTION

1. Field of the Invention

The invention relates to a rod assembly, more particularly to a foldable rod assembly for use in a detachable closet such that the closet can be folded into a suitcase.

2. Description of the Related Art

A conventional foldable rod assembly includes a first rod, a second rod, and a coupler unit. Each of the first and second rods has a connecting end of predetermined dimension provided with a pivot through hole which extends in a direction transverse thereto. The coupler unit includes an elongated piece having left and right longitudinal sides, upper and lower transverse sides, upper and lower pivot holes which are disposed in symmetry to a middle line between the upper and lower transverse sides, and a tubular sleeve member movably disposed on the elongated piece. The sleeve member has a longitudinal length greater than that of the elongated piece. A pair of pinmembers extend into the pivot through holes of the connecting ends of the first and second rods and into the upper and lower pivot holes of the elongated piece such that the connecting ends of the first and second rods are pivotable relative to each other. The tubular sleeve member is sleeved on one of the first and second rods prior to pivotal connection of the connecting ends of the first and second rods on the elongated piece. The sleeve member has upper and lower portions threadedly fastened to the first and second rods so as to enclose the connecting ends and the elongated piece therein, thereby retaining the first and second rods in a straight line.

A drawback of the conventional rod assembly resides in that, during storage, the tubular sleeve member must be unfastened from the first and second rods to permit folding of the connecting ends thereof relative to each other. Since several tubular sleeve members are needed to interconnect several pairs of the first and second rods in the conventional foldable rod assembly, it takes a considerably long time to disassemble the sleeve members from the first and second rods during folding, which accordingly inconveniences the user.

SUMMARY OF THE INVENTION

Therefore, the object of this invention is to provide a rod assembly which can be folded in a single-stroke action for increased convenience.

Another object of this invention is to provide a foldable rod assembly which can be employed together with top and bottom plates so as to form a detachable closet that can be folded into a suitcase.

Accordingly, the foldable rod assembly of this invention is adapted to be employed with top and bottom plates to form a detachable closet that can be easily converted into a suitcase. The foldable rod assembly includes a first rod, a second rod, and a coupler unit. Each of the first and second rods has a connecting end of predetermined dimension and provided with a pivot through hole which extends in a direction transverse thereto. The coupler unit includes two coupler halves. Each of the coupler halves includes an elongate plate which has right and left longitudinal sides, upper and lower transverse sides, upper and lower pivot holes which are disposed in symmetry to a middle line between the upper and lower transverse sides. A blocking member extends transversely from the right longitudinal side of the elongate plate and proximate to the upper transverse side. At least two protrusions protrude from the left longitudinal side of the elongate plate in a direction parallel to the blocking member and are respectively proximate to the upper and lower transverse sides. Each of a pair of pin members is inserted into a respective pair of the upper and lower pivot holes of the elongate plates when the latter are opposed to each other with a first transverse distance defined therebetween which is slightly larger than either of the first and the predetermined dimensions of the first and second rods while one of the elongate plates is turned 180° around the middle line. Under such a condition, the two blocking members of the elongate plates are spaced apart in a diagonal position and are located substantially in a plane defined by the right longitudinal sides of the two elongate plates, wherein each of the two protrusions of one coupler half defines a second transverse distance with one protrusion of the other coupler half proximate to the opposed transverse side, the second transverse distance being smaller than either of the predetermined dimensions of the first and second rods so as to permit either of the connecting ends which is blocked from tilting and protruding out of the plane by the corresponding one of the block members to be retained slidably over the corresponding pair of the protrusions when each of the pin members passes through the respective pivot holes of the elongate plates and the pivot through hole of a respective one of the connecting ends after the connecting ends are inserted respectively between the elongated plates of the coupler halves.

Once assembled, the first and the second rods can be folded by turning the respective connecting end to retainingly slide over the corresponding pair of the protrusions and around the pin members respectively.

Four of the foldable rod assemblies of this invention can be used together with top and bottom plates to form the detachable closet. Two distal ends of the first and second rods of each of the foldable rod assemblies can be pivotally connected to the top and bottom plates at two corresponding corners of the latter. Thus, folding of the foldable rod assemblies consequently brings the top and bottom plates closer to each other such that the folded rod assemblies are disposed between the top and bottom plates and form four lateral sides, thereby converting the closet into a suitcase.

BRIEF DESCRIPTION OF THE DRAWINGS

Other features and advantages of this invention will become more apparent in the following detailed description of the preferred embodiments of the invention, with reference to the accompanying drawings.

DETAILED DESCRIPTION OF THE PREFERRED EMBODIMENTS

Figure 1:
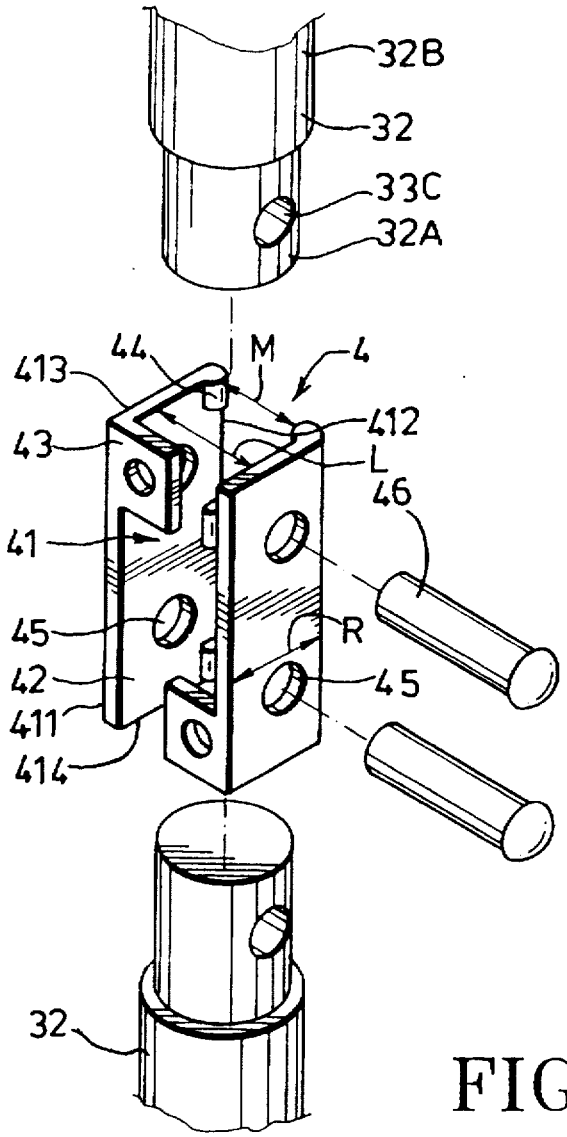
FIG. 1 is an exploded view of a foldable rod assembly of this invention.
Figure 2:
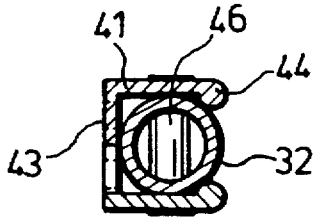
FIG. 2 is a top sectional view of the foldable rod assembly of this invention.
Figure 3:
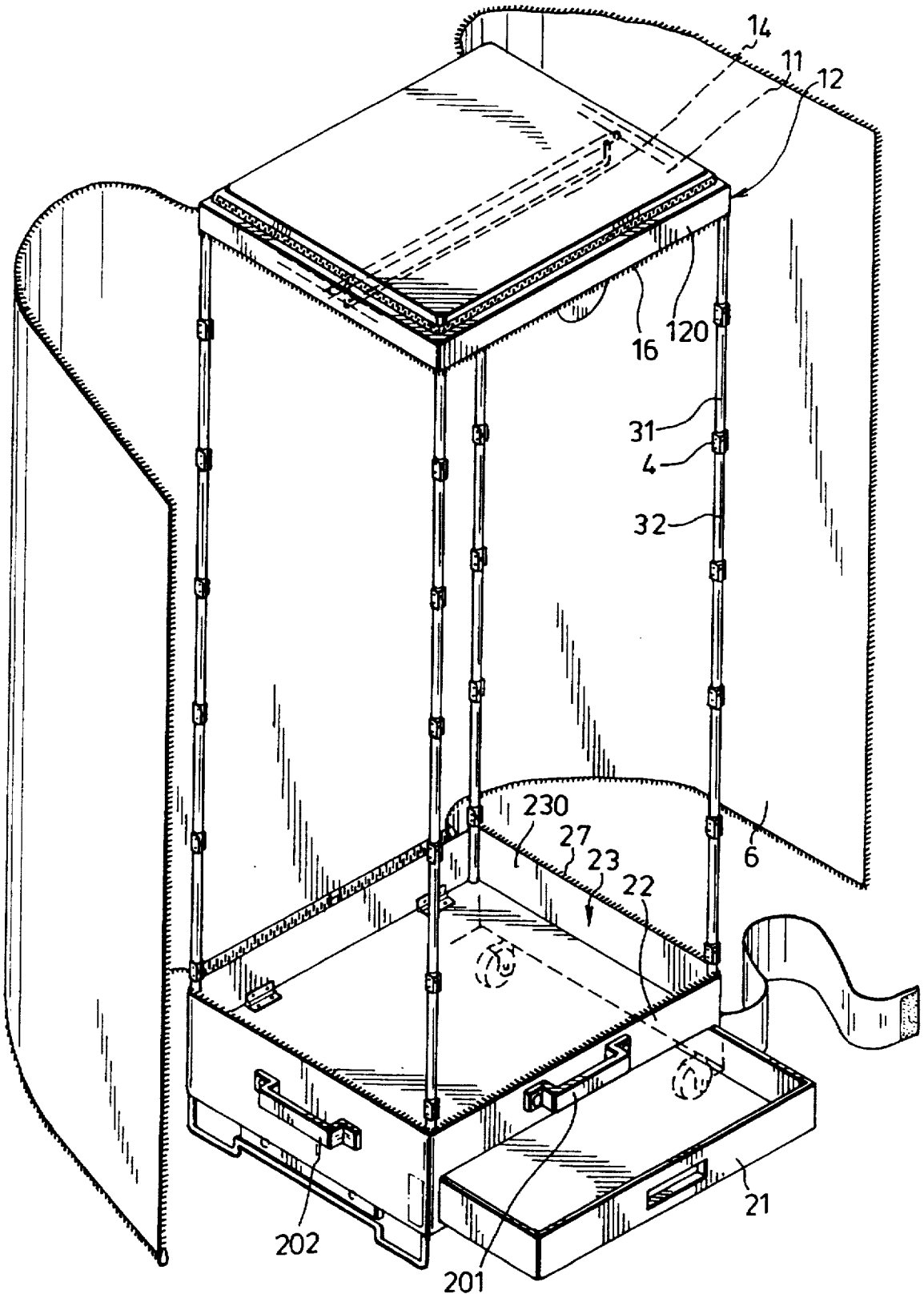
FIG. 3 illustrates a detachable closet which is formed by top and bottom plates and four foldable rod assemblies of this invention.

Referring to FIGS. 1, 2 and 3, four foldable rod assemblies of this invention are used together with a rectangular top plate 11 and a rectangular bottom plate 22 to form a detachable closet.

As illustrated, four of the foldable rod assemblies are disposed between the top and bottom plates 11, 22 at four corners of the latter so as to define a column of space among the foldable rod assemblies and between the top and bottom plates 11, 22.

Each of the foldable rod assemblies includes first and second rods 32, a coupler unit 4, and a pair of pin members 46. The first and second rods 32 have two distal ends 32B connected pivotally to the top and bottom plates 11, 22 respectively at two corresponding corners of the same, and two connecting ends 32A of a respective predetermined dimension. The connecting ends 32A of the first and second rods 32 are provided with a respective pivot through hole 32C which extends in a direction transverse to an axis of the rods 32.

The coupler unit 4 includes two coupler halves. Each of the coupler halves includes an elongate plate 41 which has right and left longitudinal sides 411, 412, upper and lower transverse sides 413, 414, and upper and lower pivot holes 45 which are disposed in symmetry to a middle line (R) between the upper and lower transverse sides 413, 414. A blocking member 43 extends transversely from the right longitudinal side 411 of the elongate plate 41 proximate to the upper transverse side 413. Two protrusions 44 protrude from the left longitudinal side 412 of the elongate plate 41 in a direction parallel to the blocking member 43 and are respectively proximate to the upper and lower transverse sides 413, 414.

Each of the pin members 46 is inserted into a respective pair of the upper and lower pivot holes 45 of the elongate plates 41 when the latter are opposed to each other with a first traverse distance (L) defined therebetween which is slightly larger than either of the predetermined dimensions while one of the elongate plates 41 is turned 180° around the middle line (R) so that the blocking members 43 of the elongate plates 41 are spaced apart in a diagonal position and are located substantially in a plane defined by the respective right longitudinal sides 411 of the elongate plates 41. Under this condition, the connecting ends 32A of the first and second rods 32 are inserted respectively into the space (L) between the elongate plates and each of the pin members 46 passes through the respective pair of pivot holes 45 of the elongate plates 41 and the pivot through hole 33C of a respective one of the first and second connecting ends 32A, thereby connecting pivotally the first and second rods 32 on the coupler unit 4. After assembly, each of the protrusions 44 on one of the elongate plates 41 defines a second transverse distance (M) with one of the protrusions 44 of the other elongate plate 41 proximate to the opposed transverse sides 413, 414, the second transverse distance (M) being smaller than either of the predetermined dimensions of the connecting ends 32A so as to permit either of the first and second connecting ends 32A which is blocked by the blocking members 43 from tilting and protruding out of the plane by the corresponding blocking members 43 to be retained slidably over the corresponding pair of protrusions 44. The first and second rods 32 can be folded with little force by turning the connecting ends 32A to retainingly slide over the corresponding pair of protrusions 44 toward each other around the pin members 46 respectively, thereby bringing the top and bottom plates 11, 22 closer to each other.

Figure 4:
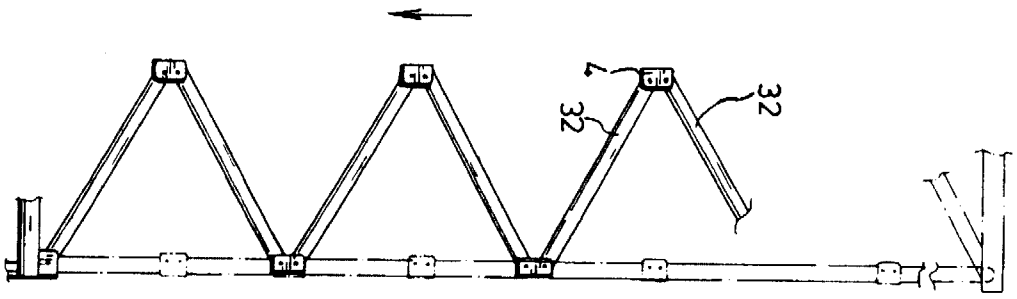
FIG. 4 illustrates how the rod assembly of this invention is folded.
Figure 5:
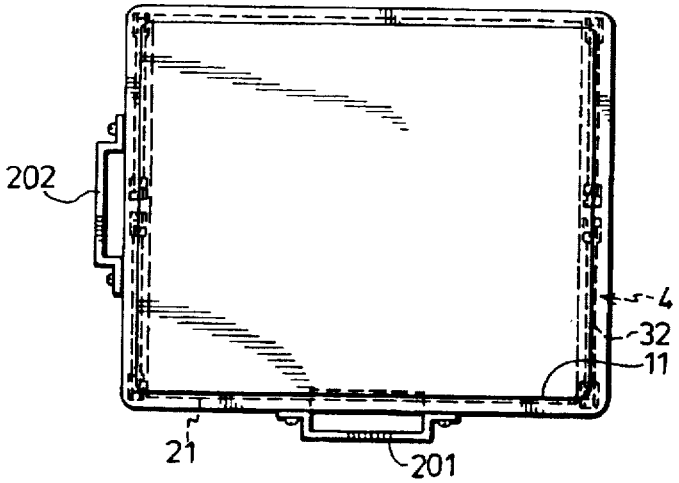
FIG. 5 is a top view of a folded closet, in which four foldable rod assemblies of this invention are employed.
Figure 6:
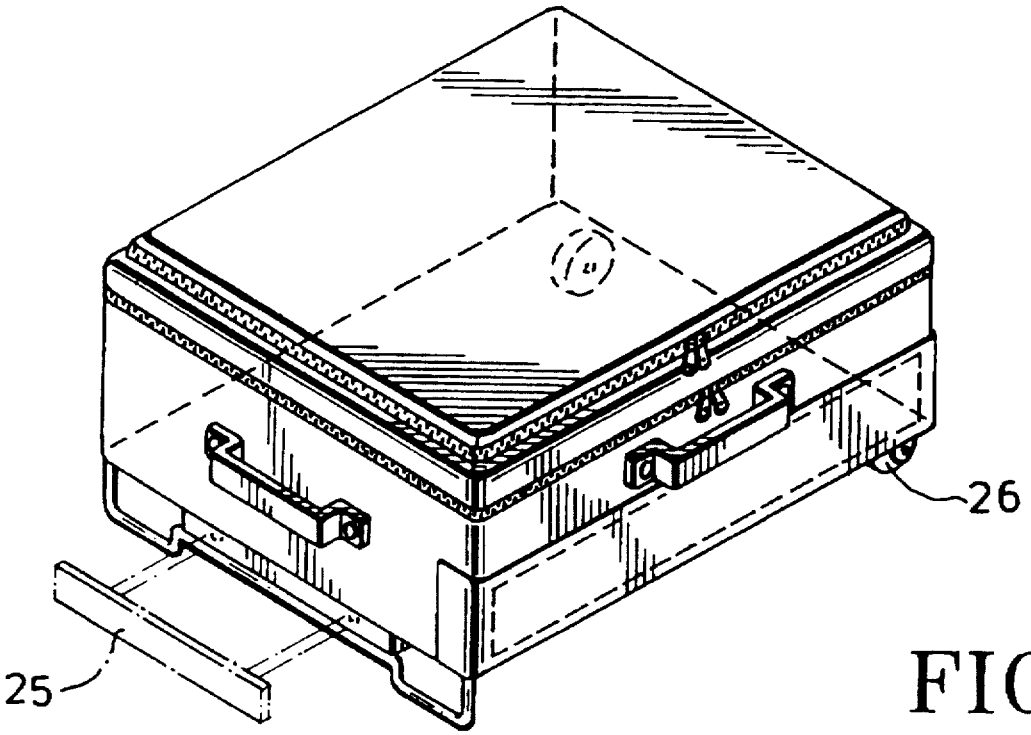
FIG. 6 is a perspective, schematic view of the suitcase which is converted from the detachable closet shown in FIG. 3.

As best illustrated in FIGS. 3, 4 and 5, since several first and second rods 32, and several coupler units 4 are employed to form the foldable rod assembly of this invention, the coupler units 4 can be pushed in a horizontal direction such that the first and second rods 32 will overlap on each other and descend downward as indicated by the arrow in FIG. 4. In the preferred embodiment, the top plate 11 is covered by a top plastic shield 12 which has a downwardly extending portion 120 provided with a zipper 16. A hanger rod 14 is attached beneath of the top plate 11 for hanging clothes thereon. The bottom plate 22 is provided with a bottom plastic shield 23 which has an upper portion 230 that covers a portion of the second rods 32. A zipper 27 is stitched to the peripheral portion of the bottom plastic shield 23 and is connectable to the zipper 120 of the top plastic shield 12 by means of an intermediate plastic shield 6 that is provided around the foldable rod assemblies and that has a fastener zipper connected to the zippers 16, 27 so as to confine the column of space of the detachable closet. A drawer 21 is attached slidably to an underside of the bottom plate 22. Two handles 201, 202 are provided on the bottom plastic shield 23 for carrying the same after the closet is converted into a suitcase. As shown in FIG. 6, a retractable hand grip 25 is provided on the bottom plate 22, while two casters 26 can be mounted rotatably on two corners of the bottom plate 22 for pulling or pushing purposes.

Figure 7:
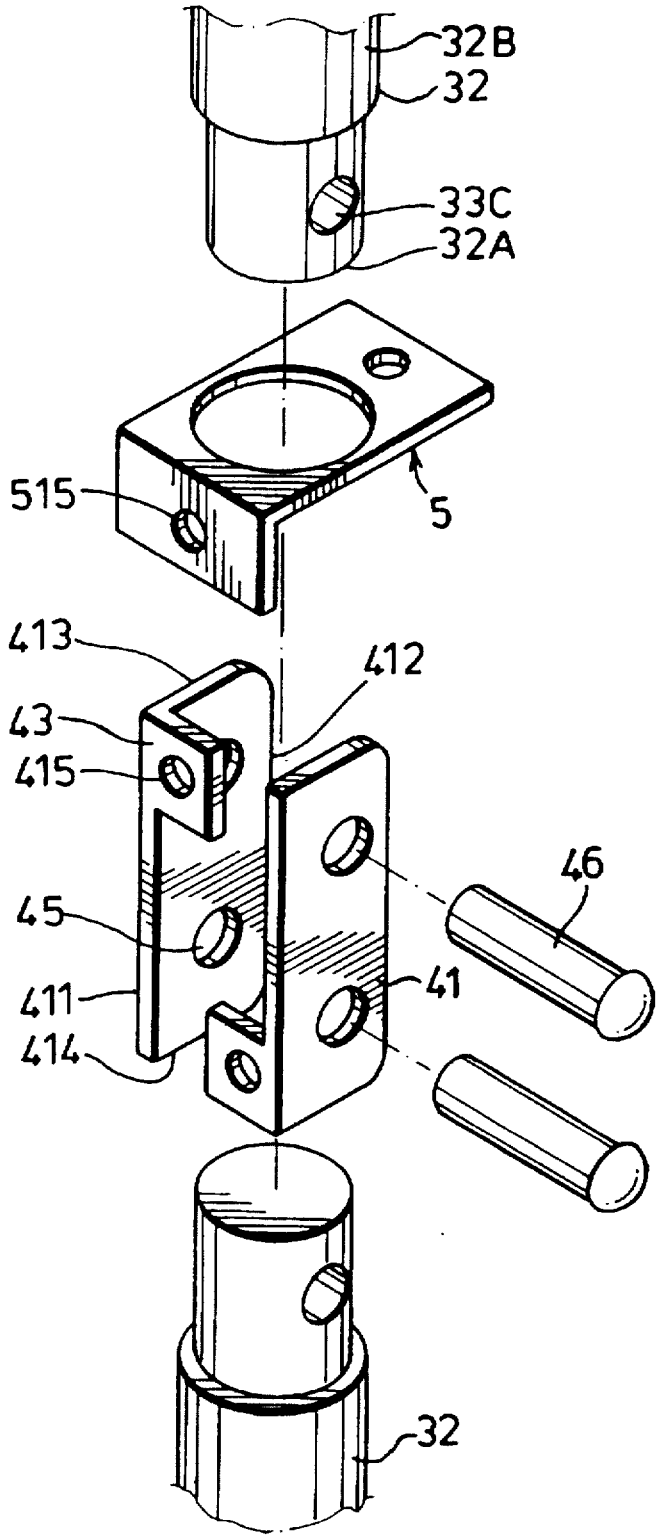
FIG. 7 is an exploded view of a modified foldable rod assembly of this invention.
Figure 8:
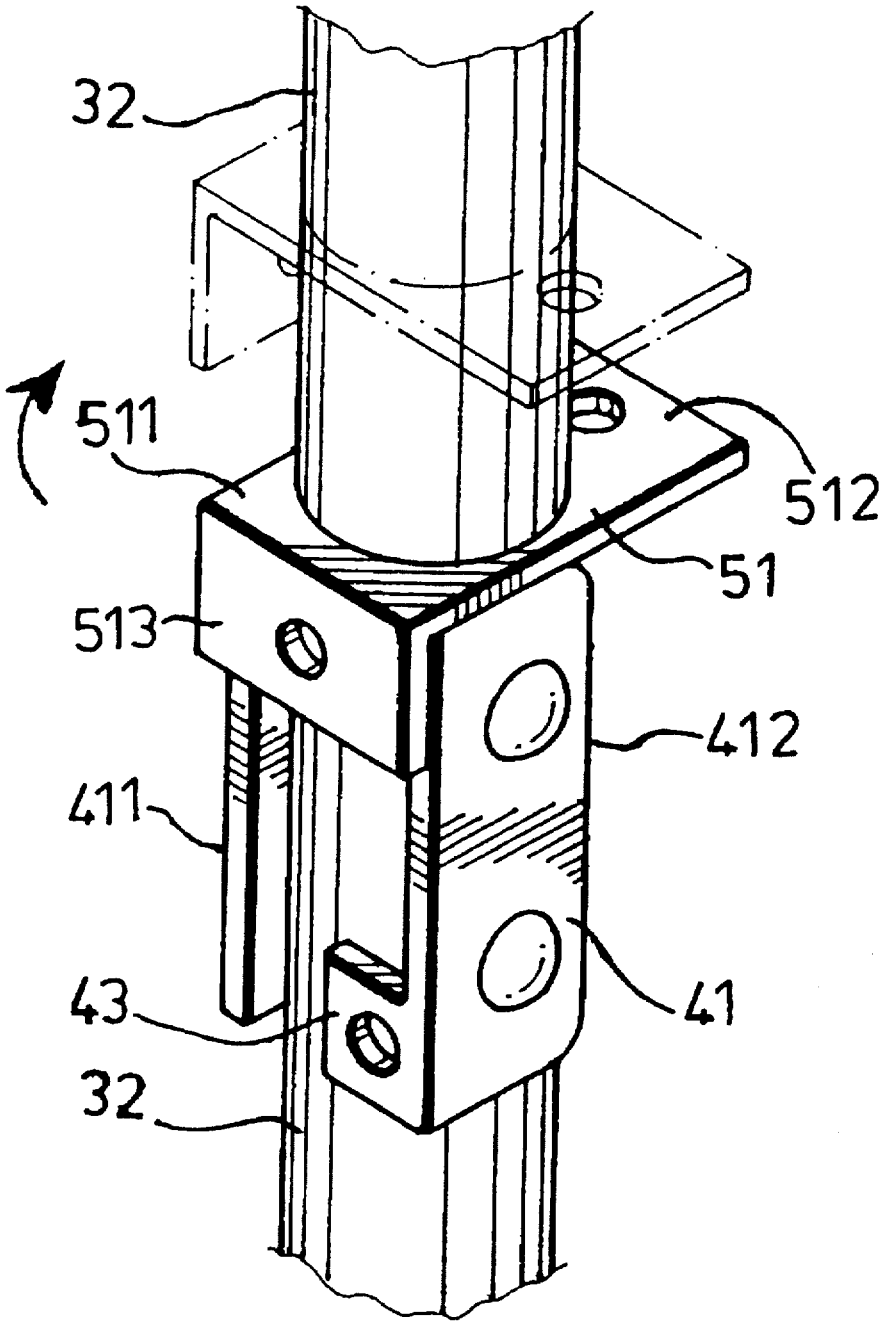
FIG. 8 is a perspective view of the modified foldable rod assembly of this invention.

Referring to FIGS. 7 and 8, a modified foldable rod assembly of this invention is shown to have a structure similar to the previous embodiment except that an L-shaped support element 5 is substituted for the protrusions 44 (see FIG. 1). As illustrated, the support element 5 includes a transverse sleeve member 51 sleeved on the first rod 32 and seated on the upper transverse sides of the elongate plates 41 after the connecting ends 32A of the first and second rods 32 have been inserted into the space between the elongate plates 41 and after the pin members 46 are inserted through the respective pair of the upper and lower pivot holes 45 of the elongate plates 41 and the pivot through hole 33C of the respective one of the first and second rods 32. The transverse sleeve member 51 includes a right end portion 511, a left end portion 512 which extends horizontally from the right end portion 511 and beyond the left longitudinal sides 412 of the elongate plates 41, and a longitudinal portion 513 which extends downwardly from the right end portion 511 for abutment against the blocking members 43. When four of the modified foldable rod assemblies of this invention are employed together with the top and bottom plates to construct a detachable closet as in the previous embodiment, the left end portions 512 of the support elements 5 respectively extend into the column of space defined among the four foldable rod assemblies so as to support a shelf (not shown) thereon. Note that the longitudinal portion 513 has a retainer hole 515 aligned with a hole 415 of the blocking member 43 for extension of a retainer bolt (not shown) in order to detachably secure the support element 5 on the elongate plates 41. Mounting of top and bottom plates as well as the plastic shields are the same as those in the previous embodiment.

While this invention has been described in connection with what is considered to the most practical and preferred embodiments, it is understood that this invention is not limited to the disclosed embodiments but is intended to cover various arrangement included within the spirit and scope of the broadest interpretation and equivalent arrangement.

I claim:

1. A foldable rod assembly comprising:

a first rod having a longitudinal axis and a first connecting end of a first dimension provided with a first pivot through hole that extends in a longitudinal axis and a direction transverse to said longitudinal axis;

a second rod having a longitudinal axis and a second connecting end of a second dimension provided with a second pivot through hole that extends in a direction transverse to said longitudinal axis;

a coupler unit including two coupler halves, each of said coupler halves including:

an elongate plate having right and left longitudinal sides, upper and lower transverse sides, and upper and lower pivot holes disposed in symmetry to a middle line between said upper and said lower transverse sides;

a blocking member extending transversely from said right longitudinal side and proximate to said upper transverse side; and at least two protrusions protruding from said left longitudinal side in a direction parallel to said blocking member and respectively proximate to said upper and lower transverse sides; and a pair of pin members, each of which is inserted into a respective pair of said upper and lower pivot holes respectively of said elongate plates when said elongate plates are opposed to each other with a first transverse distance defined therebetween which is slightly larger than either of said first and said second dimensions while one of said elongate plates is turned 180 degrees around said middle line so that said blocking members of said elongate plates are spaced apart in a diagonal position and are substantially in a plane defined by said right longitudinal sides of said elongate plates, wherein each of said two protrusions of one of said coupler halves defines a second transverse distance with one of said protrusions of the other one of said coupler halves proximate to an opposite one of said upper and lower transverse sides, said second transverse distance being smaller than either of said first and second dimensions so as to permit either of said first and second connecting ends which is blocked from tilting and protruding out of said plane by the corresponding one of said blocking members to be retained slidably over said corresponding pair of said protrusions when each of said pin members passes through said respective pair of said pivot holes of said elongate plates and said pivot through hole of a respective one of said first and second connecting ends after said first and second connecting ends are inserted respectively between said elongate plates of said coupler halves;

whereby once assembled, said first and said second rod can be folded by turning said respective connecting ends to retainingly slide over said corresponding pair of said protrusions and around said pin members, respectively.

2. A foldable rod assembly for a detachable closet, the closet including a rectangular top plate and a rectangular bottom plate, said foldable rod assembly comprising:

a first rod having a longitudinal axis and a first distal end adapted to be connected pivotally to the top plate, and a first connecting end of a first dimension provided with a first pivot through hole that extends in a direction transverse to said longitudinal axis;

a second rod having a longitudinal axis and a second distal end adapted to be connected pivotally to the bottom plate, and a second connecting end of a second dimension provided with a second pivot through hole that extends in a direction transverse to said longitudinal axis;

a coupler unit including two coupler halves, each of said coupler halves including:

an elongate plate having right and left longitudinal sides, upper and lower transverse sides, and upper and lower pivot holes disposed in symmetry to a middle line between said upper and said lower transverse sides;

a blocking member extending transversely from said right longitudinal side and proximate to said upper transverse side; and at least two protrusions protruding from said left longitudinal side in a direction parallel to said blocking member and respectively proximate to said upper and lower transverse sides; and a pair of pin members, each of which is inserted into a respective pair of said upper and lower pivot holes of said elongate plates when said elongate plates are opposed to each other with a first traverse distance defined therebetween which is slightly larger than either of said first and second dimensions while one of said elongate plates is turned 180 degrees around said middle line so that said blocking members of said elongate plates are spaced apart in a diagonal position and are located substantially in a plane defined by said right longitudinal sides of said elongate plates, wherein each of said two protrusions of one of said elongate plates defines a second transverse distance with one protrusion of the other one of said elongate plates proximate to an opposed one of said transverse sides, the second transverse distance being smaller than either of said first and said second dimensions so as to permit either of said first and second connecting ends which is blocked from tilting and protruding out of said plane by the corresponding one of said blocking members to be retained slidably over said corresponding pair of said protrusions when each of said pin members passes through said respective pair of said pivot holes of said elongate plates and said pivot through hole of a respective one of said first and second connecting ends after said first and second connecting ends are inserted respectively between said elongate plates of said coupler halves;

whereby, once assembled, said first and second rods can be folded by turning said connecting ends to retainingly slide over said corresponding pair of said protrusions toward each other and around said pin members respectively, thereby bringing said top and bottom plates closer to each other.

3. The foldable rod assembly as defined in claim 2, wherein said blocking members of said elongate plates cooperatively prevent turning of said connecting ends of said first and second rods around said pin members toward each other.

4. A foldable rod assembly comprising:

a first rod having a longitudinal axis and a first connecting end of a first dimension provided with a first pivot through hole that extends in a direction transverse to said longitudinal axis;

a second rod having a longitudinal axis and a second connecting end of a second dimension provided with a second pivot through hole that extends in a direction traverse to said longitudinal axis;

coupler unit including two coupler halves, each of said coupler halves including:

an elongate plate having right and left longitudinal sides, upper and lower transverse sides, and upper and lower pivot holes disposed in symmetry to a middle line between said upper and lower transverse sides; and a blocking member extending transversely from said right longitudinal side and proximate to said upper transverse side;

a pair of pin members, each of which is inserted into a respective pair of said upper and lower pivot holes of said elongate plates when said elongate plates are opposed to each other with a transverse distance defined therebetween which is slightly larger than either of said first and second dimensions while one of said two elongate plates is turned 180 degrees around said middle line so that said blocking members of said elongate plates are spaced apart in a diagonal position and are located substantially in a plane defined by said right longitudinal sides of said elongate plates; and a support element having a transverse sleeve member slidably sleeved on said first rod and seated on said upper transverse sides of said elongate plates when each of said pin members passes through said respective pair of said pivot holes of said elongate plates and said pivot through hole of a respective one of said first and second connecting ends after said first and second connecting ends are inserted respectively between said elongate plates of said coupler halves, said sleeve member including:

a right end portion, a left end portion extending horizontally from said right end portion beyond said left longitudinal sides of said elongate plates, and a longitudinal portion extending downwardly from said right end portion for abutment against said blocking members of said elongate plates;

whereby, once assembled, said sleeve member can be lifted axially with respects to said first rod so as to be spaced from said upper transverse sides, thereby permitting folding of said connecting ends of said first and second rods towards each other by turning around said pin members, respectively.

* * * * *